US006679387B1

(12) United States Patent
Saukkonen

(10) Patent No.: US 6,679,387 B1
(45) Date of Patent: Jan. 20, 2004

(54) ROLL APPARATUS FOR SPREADING WOOD CHIPS

(75) Inventor: Seppo Saukkonen, Porvoo (FI)

(73) Assignee: Metso Panelboard Oy, Nastola (FI)

( * ) Notice: Subject to any disclaimer, the term of this patent is extended or adjusted under 35 U.S.C. 154(b) by 0 days.

(21) Appl. No.: 10/030,690

(22) PCT Filed: Jul. 10, 2000

(86) PCT No.: PCT/FI00/00638

§ 371 (c)(1),
(2), (4) Date: Apr. 30, 2002

(87) PCT Pub. No.: WO01/07220

PCT Pub. Date: Feb. 1, 2001

(30) Foreign Application Priority Data

Jul. 26, 1999 (FI) ..... 991647

(51) Int. Cl.[7] ..... B07B 13/05
(52) U.S. Cl. ..... 209/671; 209/673
(58) Field of Search ..... 209/659, 660, 209/618, 667, 671, 673

(56) References Cited

U.S. PATENT DOCUMENTS 3,817,375 A * 6/1974 Herkes ..... 209/673
4,821,886 A * 4/1989 Roethig ..... 209/618
5,109,988 A * 5/1992 Artiano ..... 209/671 X
5,386,914 A 2/1995 Eramaja et al. ..... 209/673
5,824,356 A * 10/1998 Silver et al. ..... 209/673 X

FOREIGN PATENT DOCUMENTS

EP 0328067 A2 8/1989
SU 980656 * 12/1982 ..... 209/673

* cited by examiner

*Primary Examiner*—Tuan N. Nguyen
(74) *Attorney, Agent, or Firm*—Birch, Stewart, Kolasch & Birch, LLP

(57) ABSTRACT

Roll set for handling, particularly screening and spreading, different materials such as wood chips and shavings, the roll set including at least two parallel-mounted, rotatable rolls, whereby the interroll gaps are adapted to pass the material being handled and at least a number of the rolls are provided with a surface patterning. The roll set is implemented by providing at least some of the rolls of the roll set with at least one collar ring made thereto in an annular manner essentially about the entire circumference of the roll. The collar ring has an outer diameter advantageously at least as large as the outer diameter of the other surface patterning made on the roll.

4 Claims, 1 Drawing Sheet

ROLL APPARATUS FOR SPREADING WOOD CHIPS

This application is the national phase under 35 U.S.C. §371 of PCT International Application NO. PCT/FI00/00638 which has an International filing date of Jul. 10, 2000, which designated the United States of America and was published in English.

BACKGROUND OF THE INVENTION

1. Field of the Invention

The present invention relates to a roll set suited for the handling, particularly screening and spreading, of different materials such as wood chips or shavings, said roll set comprising at least two parallel-mounted, rotatable rolls, whereby the interroll gaps are adapted to pass the material being handled and at least a number of the rolls are provided with a surface patterning.

2. Description of Background Art

One embodiment of the above-mentioned type of roll set is disclosed in FI Pat. No. 90,746, the apparatus described therein being intended for spreading fibrous material such as chips and the like into a mat of predetermined structure formed onto an underlying spreading conveyor of a belt-type construction. This kind of roll set may also be used in roll screens employed for screening of wood chips or shavings. Roll screening can be employed in the form of a coplanar set of multiple adjacent rolls for screening mineral particles away from chips.

Such roll sets may utilize a surface-patterned roll of the type disclosed, e.g., in FI Pat. No. 89,082. This kind of surface pattern is comprised of tapering protuberances, mostly of a pyramidal shape.

When screening fine particles, the interroll gap between two adjacent rolls can be made very narrow, whereby the surface protuberances of the rolls run close to each other. During normal running, the tips of the surface protuberances do not make a contact with each other. However, in reality it happens every now and then that a thicker particle becomes jammed in the gap thus forcing it to open. Herein, the rolls bend resultingly causing the next interroll gap to close, sometimes even down to a physical contact. When the tips of the surface protuberances meet, the surface pattern will be destroyed particularly in rolls rotating in the same direction. Typically this takes place at the middle of the roll where the roll crown is largest. Such a damaged roll must be replaced, which is a very costly operation.

SUMMARY AND OBJECTS OF THE INVENTION

It is an object of the present invention to provide a roll set capable of overcoming the drawbacks of prior-art techniques. The roll set according to the invention is characterized in that at least some of the rolls of the roll set have at least one collar ring made thereto in an annular manner essentially about the entire circumference of the roll, whereby the collar ring has an outer diameter advantageously at least as large as the outer diameter of the other surface patterning made on the roll. Advantageously, the collar ring is made on at least every second roll of the roll set, whereby the surface patternings of the any two adjacent rolls cannot mesh with each other during an anomalous operating situation, but instead the tip of the surface pattern protuberance meets the surface of the collar ring of the adjacent roll. This kind of physical contact does not cause damage to the surface patterning.

A preferred embodiment of the invention is characterized in that each roll of the roll set is provided with a collar ring that is located essentially on the middle area of the axial length of the roll so that the collar rings of any two adjacent rolls are aligned in a substantially identical location along the axial length of the roll, whereby the collar rings make a physical contact with each other during an anomalous operating situation. As all the rolls of a roll set are then made substantially identical, there is no need for manufacturing a plurality of different rolls. Moreover, this kind of embodiment assures that under a crown of the roll, the surface patterning cannot make a contact not even to the collar ring of the adjacent roll, but instead, only the aligned collar rings of adjacent rolls can contact each other, whereby no damage can occur.

Another preferred embodiment of the invention is characterized in that the width of the collar ring is about 1–50 mm, advantageously about 10 mm and its height exceeds the outer diameter of the actual surface patterning 4 of the roll 1 by about 0.0–2.0 mm, advantageously by about 0.1 mm, depending on the height of the protuberances in the roll surface patterning. Accordingly, the shape and dimensions of the collar ring may be varied in a wide range as required. In practice, it is sufficient to make the collar ring to extend in the radial direction essentially to the outer circumferential diameter of the surface pattern protuberances, since then the collar ring can prevent "meshing" of the roll surface protuberances when crowning of the rolls occurs.

A still another preferred embodiment of the invention is characterized in that the collar ring has an essentially smooth outer surface. This reduces the friction between the contacting rings to a minimum.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
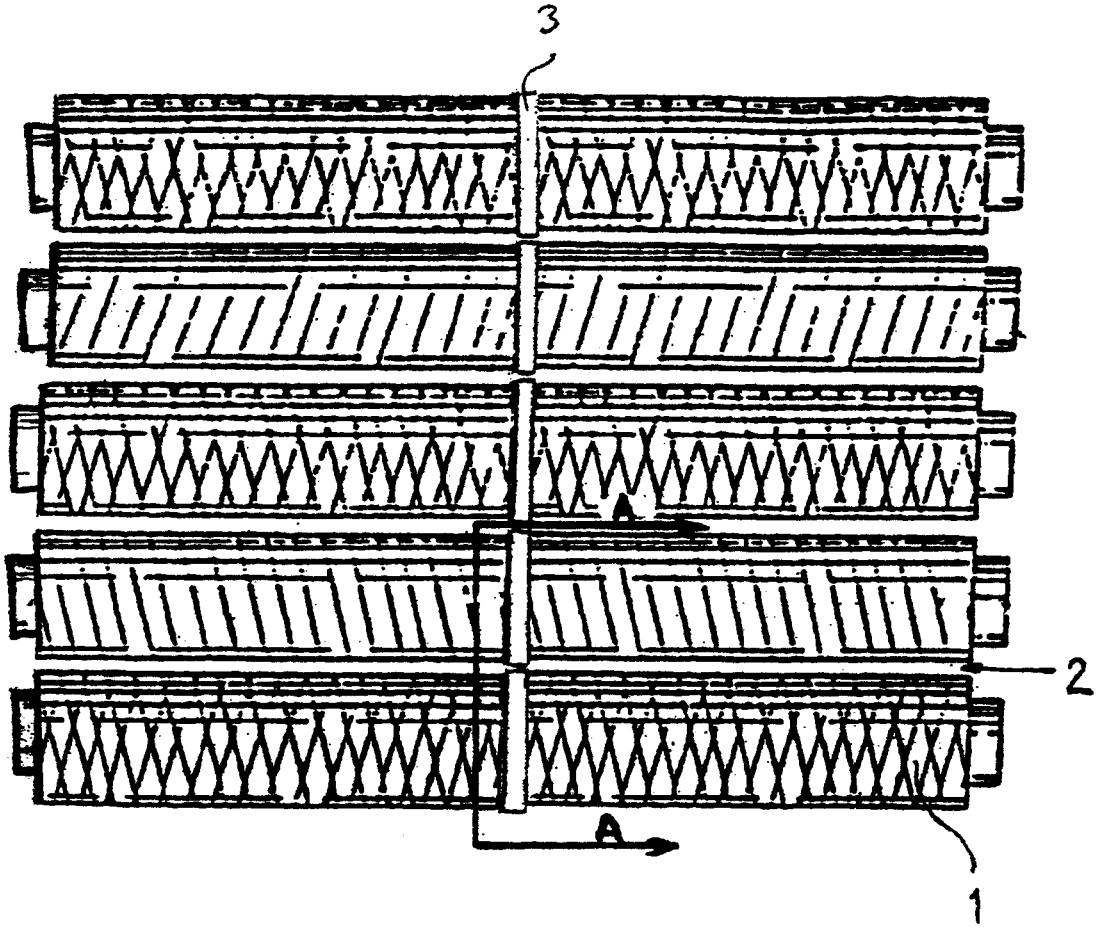
FIG. 1 shows a top view of a roll set assembled from the rolls according to the invention.

Now referring to FIG. 1, therein is shown a roll set implemented according to a preferred embodiment of the invention as an assembly comprising rolls 1. The center axes of the rolls are aligned coplanar. While the rolls are conventionally placed coplanar, also roll sets of noncoplanar rolls are possible as well within the scope and spirit of the invention. Furthermore at least a portion, most advantageously all of the rolls are arranged rotatable about their center axes. At least a portion, generally all of the rolls are provided with a surface patterning that may be of the kind described, e.g., in the above-mentioned FI Pat. No. 89,082. This kind of roll set can be employed in a plurality of applications including spreading of fibrous material as is taught in FI Pat. No. 90,746 or classification of wood chip material as is the case in cited FI Pat. No. 89,082. The roll set may also be utilized for removal of rocks from chip furnish.

To the function of the roll set, it is essential that the adjacent rolls 1 are spaced apart from each other by gaps 2 through which a desired class (desired size) of material can fall down. The gaps may be made adjustable in a manner taught in FI Pat. No. 90,746.

As described above, this kind of roll is generally provided with an appropriate surface patterning which generally is characterized by having tipped protuberances (not shown in the drawings) made thereon. When the interroll gap is adjusted especially small in order to screen or spread fines, the tips of the surface pattern protuberances of the adjacent rolls run very close to each other in a normal operating situation. As mentioned above, jamming of a larger particle in the interroll gap may cause crowning of a roll or rolls, whereby the tips of the surface protuberances in the adjacent interroll gap can meet. As the rolls 1 generally rotate in the same direction, the tangential direction of their periphery at the interroll gap is reverse to each other, whereby a physical contact between the rotating rolls is particularly destructive to the protruding tips of their surface patterning. Resultingly, the roll surface may suffer a damage beyond repair requiring a replacement of the damaged roll or rolls.

The rolls of the roll set shown in FIG. 1 are located essentially on the middle area of their axial length with a collar ring 3 that annularly encircles the entire circumference of the roll and has a diameter slightly larger than the outer diameter of the roll surface patterning. In a preferred embodiment, the width of such a collar ring is about 10 mm and its outer surface extends diametrally by about 0.1 mm above the tips of the surface patterning at any point of the roll periphery. Obviously, these dimensions are nonlimiting to the invention allowing variations therefrom. An advantageous variation range for the collar ring width has been found to be 1–50 mm, while the collar ring height may exceed the outer diameter of the surface patterning by 0.0–2.0 mm. Also other dimensions are possible depending on the intended application of the roll set that dictates the patterning and height of protuberances to be made on the roll surface. Furthermore, the number of collar rings may be greater than one and their location along the length of the roll is not limited to the middle point of the roll axis.

In the exemplifying embodiment shown in FIG. 1, the collar rings of adjacent rolls are accordingly aligned with each other to make the collar rings to meet each other accurately during a possible situation of roll contact thus protecting the actual surface patterning from damage. In practice, it has also been found sufficient to provide only every second roll of the set with a collar ring. Then, the protuberance tips of the roll surface patterning meet only the collar ring of the adjacent roll when crowning of the roll occurs, which arrangement generally appears to give sufficient protection against roll damage.

Advantageously, the outersurface of the collar rings 3 is made as smooth as possible in order to reduce the friction under a roll-to-roll contact to a minimum. This may be accomplished, e.g., by leaving the collar rings 3 unmachined when the other areas of the roll are machined to render to the surface patterning.

Figure 2:
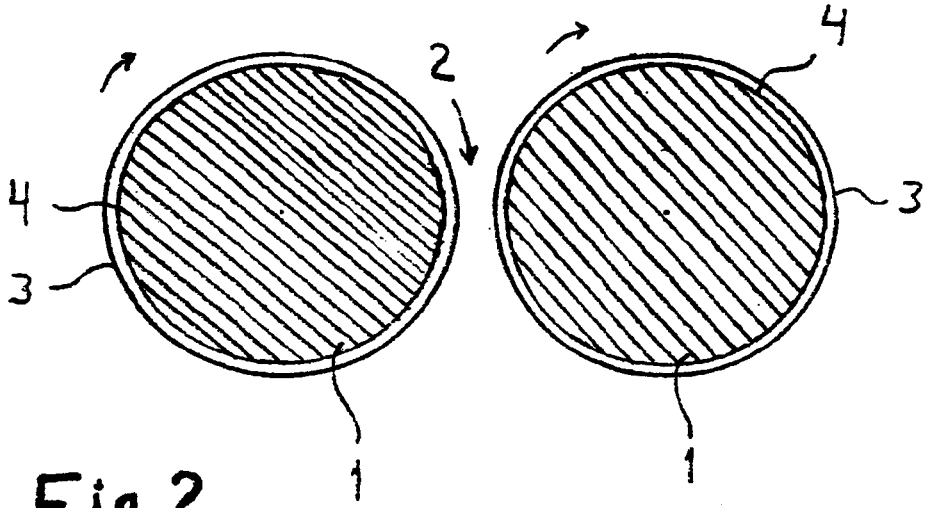
FIG. 2 shows an enlarged fragmentary view sectioned along line A—A of FIG. 1.

In the fragmentary sectional drawing of FIG. 2, the difference between the radial height of the collar ring 3 and the outer diameter of the surface patterning protuberances 4 is shown in an enlarged scale, whereby the actual dimensions may advantageously be those mentioned above. In order to elucidate the principle of the invention, the dimensions in the drawings are exaggerated from their natural proportions. In practical constructions, the length of the rolls may be advantageously selected to be 3 meters, for example.

To those skilled in the art it is obvious that the invention is not limited by the embodiments described above, but rather, can be varied within the scope and spirit of the appended claims. The collar ring may also be provided on the rolls in form of insertable rings or similar separately mountable parts.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A roll set for handling, particularly screening and spreading, of wood chips or shavings, said roll set comprising:

at least two parallel-mounted, rotatable rolls;

interroll gaps separating the rolls for passing material being handled; a surface patterning provided on at least a number of the rolls, wherein at least some of the rolls of the roll set have at least one collar ring made thereto in an annular manner essentially about the entire circumference of the roll, whereby the collar ring has an outer diameter advantageously at least as large as an outer diameter of the surface patterning made on the roll, the at least one collar ring being located essentially on a middle area of an axial length of the roll so that the collar rings of two adjacent ones of the rolls are aligned in a substantially identical location along the axial lengths of the rolls, whereby the collar rings on the adjacent rolls make a physical contact with each other during an anomalous operating situation.

2. The roll set according to claim 1, wherein the width of the collar ring is about 1–50 mm, advantageously about 10 mm and its height exceeds the outer diameter of the actual surface patterning of the roll by about 0.0–20 mm, advantageously by about 0.1 mm, depending on the height of the protuberances in the roll surface patterning.

3. The roll set according to claim 2, wherein the color ring has an essentially smooth outer surface.

4. The roll set according to claim 1, wherein the color ring has an essentially smooth outer surface.

* * * * *